US008940063B2

(12) United States Patent
Yang et al.

(10) Patent No.: US 8,940,063 B2
(45) Date of Patent: Jan. 27, 2015

(54) COATED ABRASIVE BACKINGS WITH CLOTH TREATED WITH COLLOIDAL SILICON OXIDE

(75) Inventors: Yu Xiang Yang, Shanghai (CN); Adiseshaiah K. Seshu, Bangalore (IN); Lin Hua Feng, Shanghai (CN)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 555 days.

(21) Appl. No.: 12/977,963

(22) Filed: Dec. 23, 2010

(65) Prior Publication Data

US 2011/0162286 A1 Jul. 7, 2011

(30) Foreign Application Priority Data

Dec. 29, 2009 (CN) ..... 2009 1 0266801

(51) Int. Cl.

| | |
|---|---|
| ***B24D 3/00*** | (2006.01) |
| ***B24D 11/00*** | (2006.01) |
| ***B24D 18/00*** | (2006.01) |
| ***C09K 3/14*** | (2006.01) |
| ***B24D 3/02*** | (2006.01) |
| ***C09C 1/68*** | (2006.01) |
| ***B24D 11/02*** | (2006.01) |

(52) U.S. Cl.

CPC ..... *B24D 11/02* (2013.01); *B24D 3/004* (2013.01); *B24D 11/001* (2013.01)

USPC ..... 51/298; 51/293; 51/307; 51/308

(58) Field of Classification Search

USPC ..... 51/298, 293, 307, 308

See application file for complete search history.

(56) References Cited

U.S. PATENT DOCUMENTS

| | | | | |
|---|---|---|---|---|
| 2,219,278 | A | 10/1940 | Okie | |
| 5,203,882 | A | 4/1993 | Carman et al. | |
| 5,562,745 | A * | 10/1996 | Gagliardi et al. | 51/298 |
| 5,639,546 | A | 6/1997 | Bilkadi | |
| 5,667,541 | A * | 9/1997 | Klun et al. | 51/298 |
| 5,702,811 | A | 12/1997 | Ho et al. | |
| 5,840,090 | A | 11/1998 | Ho et al. | |
| 6,120,932 | A | 9/2000 | Slipy et al. | |
| 6,852,020 | B2 * | 2/2005 | Petroski et al. | 451/526 |
| 7,344,575 | B2 * | 3/2008 | Thurber et al. | 51/298 |
| 2001/0023158 | A1 | 9/2001 | Devoe et al. | |

(Continued)

FOREIGN PATENT DOCUMENTS

| | | |
|---|---|---|
| CN | 2688446 Y | 3/2005 |
| CN | 1727423 | 2/2006 |

(Continued)

OTHER PUBLICATIONS

International Search Report for PCT/US2010/062021 mailed Aug. 19, 2011.

*Primary Examiner* — James McDonough

(74) *Attorney, Agent, or Firm* — Joseph P. Sullivan; Abel Law Group, LLP

(57) ABSTRACT

A cloth backing for an abrasive article is treated by combining a phenolic resin, a latex and a colloidal silicon oxide composition to prepare a colloidal formulation, which is then applied to the cloth backing and cured. Coated abrasive articles are formed by applying a make coat formulation to the treated cloth backing, applying an abrasive and then curing the make coat formulation.

18 Claims, 2 Drawing Sheets

Peel adhesion value of Jwt backing with different colloidal SiO2

(56) References Cited

U.S. PATENT DOCUMENTS

| | | | | |
|---|---|---|---|---|
| 2004/0142638 | A1* | 7/2004 | Petroski et al. | 451/41 |
| 2004/0219422 | A1 | 11/2004 | Hauck et al. | |
| 2004/0241539 | A1 | 12/2004 | Katayama | |
| 2006/0076923 | A1 | 4/2006 | Eaves | |
| 2007/0126397 | A1 | 6/2007 | Kogan et al. | |
| 2008/0092455 | A1* | 4/2008 | You | 51/298 |

FOREIGN PATENT DOCUMENTS

| | | | |
|---|---|---|---|
| CN | 101543978 | A | 9/2009 |
| EP | 0237784 | A1 | 9/1987 |
| EP | 0237784 | B1 | 9/1987 |
| EP | 1 027 190 | B1 | 7/2003 |
| JP | 2005-120180 | A | 5/2005 |
| WO | 2011-090686 | A2 | 7/2011 |

* cited by examiner

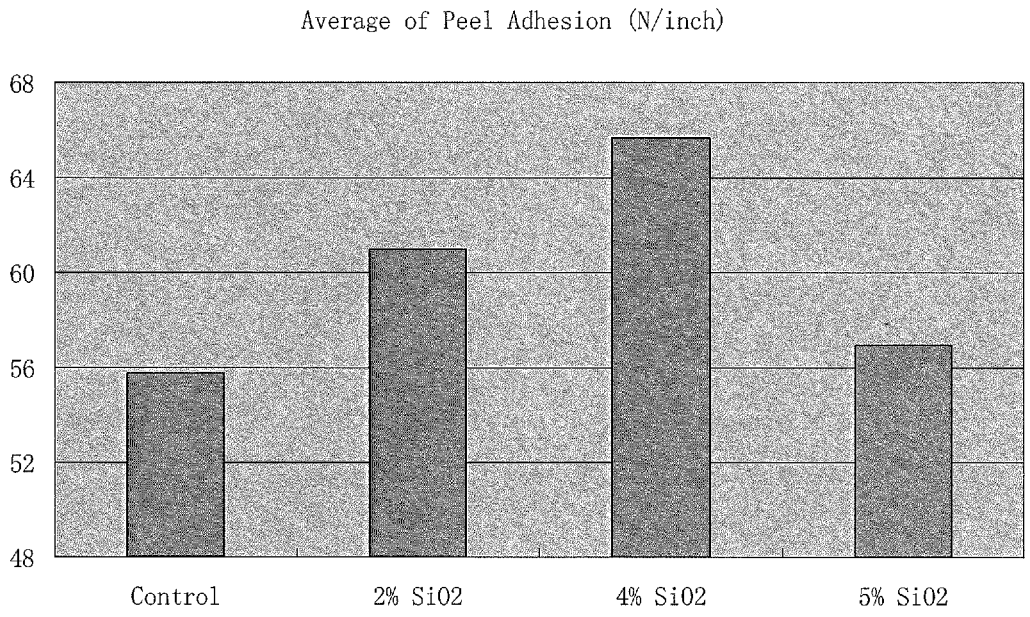
Fig. 1 Peel adhesion value of Jwt backing with different colloidal SiO2

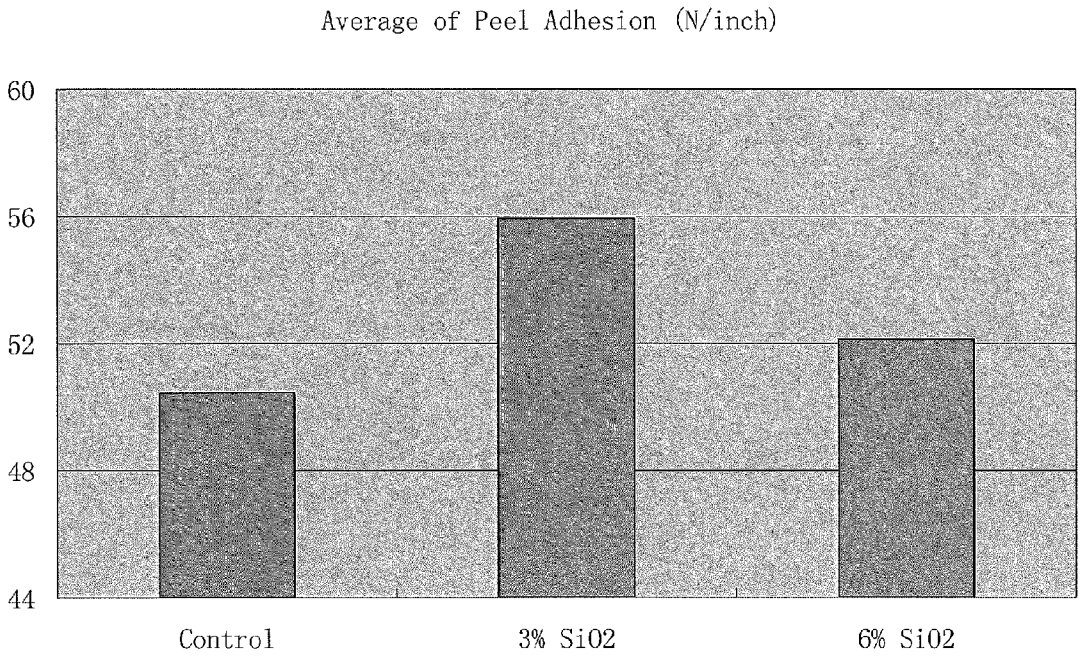
Fig. 2 Peel adhesion value of Xwt backing with different colloidal SiO2

COATED ABRASIVE BACKINGS WITH CLOTH TREATED WITH COLLOIDAL SILICON OXIDE

RELATED APPLICATIONS

This application claims priority under 35 U.S.C. §119 or 365 to Chinese Application No. 200910266801.1, filed Dec. 29, 2009.

The entire teachings of the above application are incorporated herein by reference.

BACKGROUND OF THE INVENTION

Coated abrasive articles typically include a backing substrate, abrasive grains, and a bonding system which operates to hold the abrasive grains to the backing. Generally, the backing is first coated with a layer of adhesive, commonly known as a "make coat," and then the abrasive grains are applied to the adhesive coating. The abrasive particles are at least partially embedded in the make coat. After curing, or setting, the make coat, a second layer of adhesive, referred to as a "size coat," is applied over the surface of the make coat and abrasive particles which, upon setting, further supports the particles and enhances the anchorage of the particles to the backing Optionally, a "supersize" coat which may contain grinding aids, can be applied over the cured size coat. The resulting coated abrasive product can be employed in abrasive sheets, rolls, belts and disks.

Coated abrasives suffer from the possibility that the make coat will peel away from the backing during use. Examples of known methods for treating cloth backings include application of polyvinyl alcohol, starch, latex and phenolic resins. However, all of these methods of treatment suffer from limitations, such as inadequate adhesion, lack of heat or wear resistance, or susceptibility to degradation in the presence of water.

Therefore, a need exits for a method of treating a cloth backing of a coated abrasive product that overcomes or minimizes the above-referenced problems.

SUMMARY OF THE INVENTION

The invention is generally directed to a method for treating a cloth backing of an abrasive article, a method of forming a coated abrasive article that includes treating the cloth backing by the method of the invention, and to a treated cloth backing and abrasive article that includes the treated cloth backing.

In one embodiment, the method for treating a cloth backing of an abrasive article includes combining a phenolic resin, a latex and a colloidal silicon oxide composition to thereby prepare a colloidal formulation. The colloidal formulation is applied to a cloth backing and then cured, thereby treating the cloth backing.

In another embodiment, the method is directed to forming a coated abrasive article that includes the step of combining a phenolic resin, a latex and a colloidal silicon oxide composition, thereby preparing a colloidal formulation. The colloidal formulation is applied to a cloth backing and then cured to form the cloth backing. The treated cloth backing is coated with a make formulation and an abrasive is applied to the make formulation on the coated cloth backing The make formulation is then cured to thereby form the coated abrasive article.

In still another embodiment, the invention is directed to a treated cloth backing formed by a method that includes combining a phenolic resin, a latex and a colloidal silicon oxide composition to thereby prepare a colloidal formulation. The colloidal formulation is applied to a cloth backing and then cured to thereby form the treated cloth backing.

In yet another embodiment, the invention is an abrasive article formed by a method that includes combining a phenolic resin, a latex and a colloidal silicon oxide composition to thereby prepare a colloidal formulation. The colloidal formulation is applied to the cloth backing and then cured, thereby treating the cloth backing. A make formulation and an abrasive are applied to coat the cloth backing. The make formulation is cured to form the coated abrasive article.

The coated abrasives of the invention exhibit enhanced adhesion, heat and wear resistance and are relatively water proof as compared to typical coated abrasives wherein cloth backings have been treated in a conventional manner. The coated abrasives of the invention exhibit a higher peel adhesion value in the treated backing as a consequence of the method for treating the cloth backing of the coated abrasive articles of the invention.

BRIEF DESCRIPTION OF THE DRAWINGS

FIG. 1 is a histogram of peel adhesion value of coated backings of the invention relative to a control.

FIG. 2 is a histogram of another comparison of coated backings of the invention relative to a control.

DETAILED DESCRIPTION OF THE INVENTION

The foregoing will be apparent from the following more particular description of example embodiments of the invention, as illustrated in the accompanying drawings in which like reference characters refer to the same parts throughout the difference views. The drawings are not necessarily to scale, emphasis instead being placed on illustrating embodiments of the present invention.

The invention generally is directed to a method for treating a cloth backing of an abrasive article, to a method of forming a coated abrasive article that includes the coated cloth backing, to a treated cloth backing formed by the method, and to an abrasive article formed by the method of the invention.

In one embodiment, the invention is a method for treating a cloth backing of an abrasive article. The method includes combining a phenolic resin, a latex and a colloidal oxide composition to thereby prepare a colloidal formulation. Examples of suitable phenolic resins are known to those of skill in the art of forming coated abrasive articles. Examples of suitable phenolic resins include resoles, resoles modified with glycols, a diphenolic resin or a polyphenolic resin. Specific examples of suitable phenolic resins include Dynea 5030A, Hangzhou Yatai RD712, etc.

Examples of suitable latexes that for use in the method of the invention include acrylic latex, butadiene-acrylonitrile latex and styrene-butadiene latex.

The colloidal silicon oxide composition is formed by nano Silica oxide, water, and dispersant, which is commercially available. Generally, the colloidal silicon has a colloidal particle size in a range of between about 2 nanometers and about 200 nanometers. In a preferred embodiment, the colloidal particle size is in a range of between about 2 nanometers and about 50 nanometers.

The phenolic resin, latex and colloidal silicon oxide composition are combined by a suitable method, such as mixing the colloidal and latex first, then adding the phenolic resin into the solution with stirring to thereby prepare a colloidal formulation. In one embodiment, the phenolic resin is present in the colloidal formulation in an amount in a range of between about 10% and 50% by weight of the formulation.

Generally, the colloidal silicon oxide is present in the formulation in an amount in a range of between about 1% to about 10% by weight of the colloidal formulation.

An example of a suitable amount of latex in the colloidal formulation is an amount in a range of between about 30% and about 90% by weight of the formulation.

The colloidal formulation is then applied to a cloth backing by a suitable method. Examples of suitable cloth backings include those which incorporate at least one material selected from the group consisting of polycotton, cotton, polyester and nylon. Specific examples of suitable cloth backings include cotton, polycotton, and polyester. In a preferred embodiment, the cloth backing includes polycotton.

The amount of colloidal formulation applied to the cloth backing typically is in a range of between about 10 grams per square meter and about 100 grams per square meter. For example, in one embodiment, the formulation is applied to the cloth backing in an amount of greater than about 25 grams per square meter and less than about 25 grams per square meter.

An example of a suitable method of applying the colloidal formulation to the cloth backing is saturation and knife coating on square side.

After application of the colloidal formulation to the cloth backing, the colloidal formulation is cured. In one embodiment, the colloidal formulation is cured by heating the formulation on the cloth backing to a temperature in range of between about 80° C. and about 170° C. , for a period of time in a range of between about 1 min and about 5 min. In a preferred embodiment, the colloidal formulation of the cloth backing are heated to a temperature in a range of between about 100° C. and about 160° C. for a period of time in a range of between about 1 min and about 5 min.

Upon completion of curing the colloidal formulation, the cloth backing is considered to have been treated.

The treated cloth is then coated with a make coat formulation. Examples of suitable make coat formulations include 54% phenolic resin, and 43% CaCO3 and 3% water. The make coat formulation can be any of those considered suitable for forming coated abrasive articles by those of skill in the art. The make coat formulation can be applied by any suitable method, such as are known by those of skill in the art. Examples of suitable methods of applying the make coat formulation include coating using a two roll coater. Typically the amount of make coat formulation applied to the treated cloth is in a range of between about 20 grams per square meter and about 350 per square meter.

A suitable abrasive is then applied to the make coat formulation on the coated cloth backing. The abrasive can be any suitable abrasive, such as are known to those skilled in the art. Examples of suitable abrasives include aluminum oxide ($Al_2O_3$), zirconium oxide ($ZrO_2$) and silicon carbide (SiC). In one preferred embodiment, the abrasive includes aluminum oxide. Typically the particle size of the abrasive is in a range of between about P24 and about P2000. Also, the amount of abrasive applied to the coated cloth backing typically is in a range of between about 30 grams per square meter and about 1000 grams per square meter.

The make coat formulation is then cured at a suitable temperature for a suitable period of time. In one embodiment, the make coat formulation is cured by heating the formulation with the abrasive for a period of time in a range of between about 15 minutes and about 60 minutes, and at a temperature in a range of between about 60° C. and about 115° C. Upon completion of curing the make coat formulation, the coated abrasive article of the invention is formed.

Optionally, size coats and supersize coats may be applied, such as are known in the art.

The invention also includes a treated cloth backing and an abrasive article, both of which can be formed by the methods described above.

Exemplification

Raw Materials

Singed, desized Jwt polycotton backing (20*20, 107*48 2/1) from Huayue company.

Singed Xwt polycotton backing (22/2*18, 73* 51 3/1) from Huayue company, other chemical are listed in Table 1.

TABLE 1

Raw Materials

| Raw material | Solid % | pH | Glass temperature | Vendor |
|---|---|---|---|---|
| Phenolic resin RD712 | 77 | 8.5 | | Huangzhou Yai Tai |
| Phenolic resin 5030 | 78 | | | Dynea |
| VT-LA NBR | 44.5 | | | Bayer |
| QF11-3101 NBR | 47 | 8.5 | −20° C. | Shanghai |
| Colloidal SiO2 | 30% | 9 | | Shanghai yuanzi neng |

Experiment 1 Jwt Backing Treating

The coating solution for Jwt backing are shown at table 2. Mixing the VT-LA and colloid SiO2 first, then add phenolic resin RD712 to the solution with stirring until a uniform solution is formed.

TABLE 2

Coating formulation for Jwt backing

| | RD712 wt % | VT-LA wt % | Colloid $SiO_2$ wt % |
|---|---|---|---|
| Control | 25 | 75 | 0 |
| Experiment 1 | 23 | 75 | 2 |
| Experiment 2 | 21 | 75 | 4 |
| Experiment 3 | 20 | 75 | 5 |

Coating above solution on polycotton backing with knife coating machine, applied about 25 g/m2 coating weight on square side , cure it at 150° C. for 5 min in the oven with clip. Then coating the first treated backing again with knife coating machine, applied about 25 g/m2 coating weight, cure it at 150° C. for 5 min in the oven with clip.

Coated the treated backing with make formulation (54% phenolic resin, 43% CaCO3 and 3% water and applied Al203 mineral on the maker and cured in the oven.

Apply Epoxy resin (such as Epon 828) and curing agent (such as Versamid 125) on the mineral side of the sample, fold them together and add 50 lb pressure on the samples at in room temperature for 24 h.

Cut the folded samples to 10 inch *1 inch pieces and peel them with Instron machine, the results are listed at Table 3:

TABLE 3

Jwt backing peel adhesion results

| | Average of Peel Adhesion (N/inch) | Peel Adhesion (lb/inch) |
|---|---|---|
| Control | 55.74 | 12.5 |
| 2% SiO2 | 60.96 | 13.7 |
| 4% SiO2 | 65.68 | 14.8 |
| 5% SiO2 | 56.93 | 12.8 |

Experiment 2 Xwt Backing Treating

The coating solution for Xwt backing are shown at table 2. Mixing the latex QF1103101 and colloid SiO2 first, then add phenolic resin 5030 A to the solution with stirring until a uniform solution is formed Coating solution for Xwt backing are shown at table 4.

TABLE 4

Frontfill formulation for Xwt backing

| | RD712 wt % | VT-LA wt % | Colloid $SiO_2$ % |
|---|---|---|---|
| Control | 25 | 75 | 0 |
| Experiment 1 | 23 | 75 | 2 |
| Experiment 2 | 21 | 75 | 4 |
| Experiment 3 | 20 | 75 | 5 |

Coating above solution on Xwt polycotton backing with knife coating machine, applied about 30 g/m2 coating weight on square side , cure it at 150° C. for 5 min in the oven with clip. Then coating the first treated backing again with knife coating machine, applied about 25 g/m2 coating weight, cure it at 150° C. for 5 min in the oven with clip.

Coated the treated backing with make formulation (54% phenolic resin, 43% CaCO3 and 3% Water and then applied Al2O3 mineral on the make solution then cured them in the oven. Apply epoxy and curing agent on the mineral side of the sample, fold them together and add pressure on the sample at in room temperature for 24 h. Cut samples to 10 inch* 1 inch and peel the treated backing with Instron machine. The results are listed at Table 5.

TABLE 5

Jwt backing peel adhesion results

| | Average of Peel Adhesion (N/inch) | Peel Adhesion (lb/inch) |
|---|---|---|
| Control | 50.44 | 11.3 |
| 3% SiO2 | 55.93 | 12.6 |
| 6% SiO2 | 52.11 | 11.7 |

Equivalents

While this invention has been particularly shown and described with reference to preferred embodiments thereof, it will be understood by those skilled in the art that various changes in form and details may be made therein without departing from the scope of the invention encompassed by the appendant claims. The teachings of all patents, published applications and references cited herein are incorporated by reference in their entirety.

What is claimed is:

1. A method of forming a treated cloth backing comprising:

mixing a phenolic resin, a latex, and a colloidal silicon oxide composition to form a colloidal formulation;

applying the colloidal formulation directly to a cloth backing; and curing the colloidal formulation to form the treated cloth backing.

2. The method of claim 1, wherein applying the colloidal formulation directly to the cloth backing comprises coating the cloth backing.

3. The method of claim 1, wherein applying the colloidal formulation directly to the cloth backing comprises saturating the cloth backing.

4. The method of claim 1, wherein the colloidal formulation comprises about 1% to 10% colloidal silicon oxide composition by weight of the colloidal formulation.

5. The method of claim 4, wherein the colloidal formulation comprises about 2% to 6% colloidal silicon oxide composition by weight of the colloidal formulation.

6. The method of claim 1, wherein the colloidal formulation comprises about 30% to about 90% latex by weight of the colloidal formulation.

7. The method of claim 1, wherein the colloidal formulation comprises about 10% to 50% phenolic resin by weight of the colloidal formulation.

8. The method of claim 1, wherein the colloidal silicon oxide composition has a colloid particle size in a range of between about 2 nanometers and about 200 nanometers.

9. The method claim 1, wherein the phenolic resin is at least one member of the group consisting of a resole, a resole modified with a glycol, a diphenolic resin, and a polyphenolic resin.

10. The method of claim 1, wherein the latex is at least one member of the group consisting of acrylic latex, butadiene-acrylonitrile latex, and styrene-butadiene latex.

11. The method of claim 1, wherein the cloth backing comprises at least one material selected from the group consisting of polycotton, cotton, polyester, and nylon.

12. The method of claim 1, wherein the cloth backing comprises polycotton.

13. The method of claim 1, wherein the colloidal formulation is applied in an amount of about 10 grams per square meter to about 120 grams per square meter of the cloth backing material.

14. The method of claim 1, wherein the colloidal formulation comprises about 1 to 10 wt % colloidal silicon oxide composition, about 30 to 90 wt % latex, and about 10 to 50 wt % phenolic resin.

15. The method of claim 14, wherein the colloidal formulation is applied in an amount of about 10 grams per square meter to about 120 grams per square meter of the cloth backing material.

16. The method of claim 1, wherein the mixing of the phenolic resin, the latex, and the colloidal silicon oxide composition to form a colloidal formulation comprises:

mixing together the latex and the colloidal silicon oxide composition to form a mixture; and mixing the phenolic resin with the mixture to form the colloidal formulation.

17. The method of claim 1, wherein the colloidal silicon oxide composition comprises nano sized silicon oxide, water, and dispersant.

18. The method of claim 17, wherein the colloidal silicon oxide composition has a colloidal particle size in a range of 2 nanometers to 200 nanometers.

* * * * *

UNITED STATES PATENT AND TRADEMARK OFFICE

CERTIFICATE OF CORRECTION

PATENT NO. : 8,940,063 B2
APPLICATION NO. : 12/977963
DATED : January 27, 2015
INVENTOR(S) : Yang et al.

It is certified that error appears in the above-identified patent and that said Letters Patent is hereby corrected as shown below:

In the specification,

Column 5, line 7, delete Table 4 and insert the following:

Table 4 Frontfill formulation for Xwt backing

| | RD712 wt% | VT-LA wt% | Colloid $SiO_2$ wt% |
|---|---|---|---|
| Control | 20 | 80 | 0 |
| Experiment 1 | 17 | 80 | 3 |
| Experiment 2 | 14 | 80 | 6 |

-- --

Signed and Sealed this
Twenty-second Day of March, 2016

Michelle K. Lee

Michelle K. Lee
*Director of the United States Patent and Trademark Office*